US009433300B2

(12) United States Patent
Gibson et al.

(10) Patent No.: US 9,433,300 B2
(45) Date of Patent: Sep. 6, 2016

(54) TOPPER FOR A PATIENT SURFACE

(71) Applicant: Hill-Rom Services, Inc., Batesville, IN (US)

(72) Inventors: Luke Gibson, Greensburg, IN (US); Joshua A Williams, Harrison, OH (US); Rachel L. Williamson, Batesville, IN (US); Bryan W. Wuebker, Harrison, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 14/190,969

(22) Filed: Feb. 26, 2014

(65) Prior Publication Data

US 2014/0237726 A1 Aug. 28, 2014

Related U.S. Application Data

(60) Provisional application No. 61/770,704, filed on Feb. 28, 2013.

(51) Int. Cl.

| | |
|---|---|
| ***A47C 21/04*** | (2006.01) |
| ***A61G 7/057*** | (2006.01) |
| *A61G 7/00* | (2006.01) |

(52) U.S. Cl.

CPC ..... *A47C 21/044* (2013.01); *A61G 7/057* (2013.01); *A61G 7/05746* (2013.01); *A61G 7/05776* (2013.01); *A61G 7/001* (2013.01); *A61G 2203/20* (2013.01)

(58) Field of Classification Search

CPC ..... A61G 2007/05784; A61G 2007/05792; A61G 2210/70; A61G 2210/90; A47C 31/006; A47C 21/04; A47C 21/046; A47C 7/746

USPC ..... 5/421, 423, 691, 726, 652.1, 652.2

See application file for complete search history.

(56) References Cited

U.S. PATENT DOCUMENTS

| | | | |
|---|---|---|---|
| 3,644,950 | A | 2/1972 | Lindsay, Jr. |
| 3,757,366 | A | 9/1973 | Sacher |
| 3,778,851 | A | 12/1973 | Howorth |
| 4,225,989 | A | 10/1980 | Corbett et al. |
| 4,267,611 | A | 5/1981 | Agulnick |
| 4,347,633 | A | 9/1982 | Gammons et al. |
| 4,391,009 | A | 7/1983 | Schild et al. |
| 4,483,030 | A | 11/1984 | Flick et al. |
| 4,653,130 | A | 3/1987 | Senoue et al. |
| 4,862,538 | A | 9/1989 | Spann et al. |

(Continued)

FOREIGN PATENT DOCUMENTS

| | | | |
|---|---|---|---|
| AU | 2007249236 | A1 | 11/2008 |
| AU | 2007249236 | B2 | 8/2011 |

(Continued)

OTHER PUBLICATIONS

Search Report and Written Opinion from the European Patent Office for Application No. 14156946.7-1651, completed Jun. 25, 2014, 6 pages.

*Primary Examiner* — Robert G Santos
*Assistant Examiner* — Myles Throop
(74) *Attorney, Agent, or Firm* — Barnes & Thornburg LLP

(57) ABSTRACT

A topper for a patient support surface includes an actively-cooled region that is positioned to deliver air flow under a specific area to provide localized treatment and/or moisture removal to a patient supported on the topper.

22 Claims, 6 Drawing Sheets

(56) References Cited

U.S. PATENT DOCUMENTS

| | | | | |
|---|---|---|---|---|
| 4,944,060 | A | 7/1990 | Peery et al. | |
| 4,970,743 | A | 11/1990 | Wride et al. | |
| 5,010,608 | A | 4/1991 | Barnett et al. | |
| 5,103,519 | A | 4/1992 | Hasty | |
| 5,216,768 | A | 6/1993 | Bodine et al. | |
| 5,370,439 | A | 12/1994 | Lowe et al. | |
| 5,375,273 | A | 12/1994 | Bodine et al. | |
| D355,488 | S | 2/1995 | Hargest et al. | |
| 5,473,783 | A * | 12/1995 | Allen | 5/652.2 |
| 5,487,196 | A | 1/1996 | Wilkinson et al. | |
| 5,493,742 | A | 2/1996 | Klearman | |
| 5,509,155 | A | 4/1996 | Zigarac et al. | |
| 5,568,660 | A | 10/1996 | Raburn et al. | |
| 5,687,438 | A | 11/1997 | Biggie et al. | |
| 5,715,695 | A * | 2/1998 | Lord | 62/259.3 |
| 5,749,109 | A * | 5/1998 | Kappel | 5/423 |
| 5,755,000 | A | 5/1998 | Thompson | |
| 5,797,155 | A | 8/1998 | Maier et al. | |
| 5,870,785 | A | 2/1999 | Hoorens | |
| 5,887,304 | A | 3/1999 | von der Heyde | |
| 5,926,884 | A | 7/1999 | Biggie et al. | |
| 5,987,668 | A | 11/1999 | Ackley | |
| 6,182,315 | B1 * | 2/2001 | Lee | 5/690 |
| 6,782,574 | B2 | 8/2004 | Totton et al. | |
| 7,191,480 | B2 | 3/2007 | Romano et al. | |
| 7,296,314 | B2 | 11/2007 | Wyatt et al. | |
| 7,296,315 | B2 | 11/2007 | Totton et al. | |
| 7,469,432 | B2 | 12/2008 | Chambers | |
| 7,469,436 | B2 | 12/2008 | Meyer et al. | |
| 7,509,698 | B2 | 3/2009 | Poulos | |
| 7,536,739 | B2 | 5/2009 | Poulos | |
| 7,587,776 | B2 | 9/2009 | Poulos | |
| 7,617,555 | B2 | 11/2009 | Romano et al. | |
| 7,676,862 | B2 | 3/2010 | Poulos et al. | |
| 7,698,765 | B2 | 4/2010 | Bobey et al. | |
| 7,712,164 | B2 | 5/2010 | Chambers | |
| 7,716,766 | B2 | 5/2010 | Poulos | |
| 7,725,963 | B2 | 6/2010 | Johnson | |
| 7,743,441 | B2 | 6/2010 | Poulos et al. | |
| 7,757,318 | B2 | 7/2010 | Poulos et al. | |
| 7,779,494 | B2 | 8/2010 | Poulos et al. | |
| 7,849,545 | B2 | 12/2010 | Flocard et al. | |
| 7,914,611 | B2 | 3/2011 | Vrzalik et al. | |
| 7,937,791 | B2 | 5/2011 | Meyer et al. | |
| 7,954,186 | B2 | 6/2011 | Flick | |
| 7,966,680 | B2 | 6/2011 | Romano et al. | |
| 7,975,331 | B2 | 7/2011 | Flocard et al. | |
| 7,975,335 | B2 * | 7/2011 | O'Keefe et al. | 5/616 |
| 8,037,563 | B2 | 10/2011 | Richards et al. | |
| 8,056,160 | B2 | 11/2011 | Poulos et al. | |
| 8,069,514 | B2 | 12/2011 | Poulos et al. | |
| 8,108,957 | B2 | 2/2012 | Richards et al. | |
| 8,118,920 | B2 | 2/2012 | Vrzalik et al. | |
| 8,146,191 | B2 | 4/2012 | Bobey et al. | |
| 8,156,589 | B2 | 4/2012 | Liu et al. | |
| 8,191,187 | B2 | 6/2012 | Brykalski et al. | |
| 8,196,240 | B2 | 6/2012 | Meyer et al. | |
| 8,220,090 | B2 | 7/2012 | Gowda | |
| 8,332,975 | B2 | 12/2012 | Brykalski et al. | |
| 8,347,436 | B2 | 1/2013 | Flick et al. | |
| 8,372,182 | B2 | 2/2013 | Vrzalik et al. | |
| 8,397,327 | B2 | 3/2013 | O'Reagan | |
| 8,402,579 | B2 | 3/2013 | Marquette et al. | |
| 8,418,286 | B2 | 4/2013 | Brykalski et al. | |
| 8,474,074 | B2 | 7/2013 | O'Keefe et al. | |
| 8,584,279 | B2 | 11/2013 | Richards et al. | |
| 8,601,620 | B2 | 12/2013 | Romano et al. | |
| 8,621,687 | B2 | 1/2014 | Brykalski et al. | |
| 8,719,984 | B2 | 5/2014 | Miller et al. | |
| 8,732,874 | B2 | 5/2014 | Brykalski et al. | |
| 9,009,892 | B2 * | 4/2015 | Lachenbruch | A61G 7/057 5/606 |
| 9,125,497 | B2 * | 9/2015 | Brykalski | A47C 21/048 |
| 9,131,781 | B2 * | 9/2015 | Zaiss | A47C 21/044 |
| 2002/0129449 | A1 * | 9/2002 | Harker | 5/726 |
| 2003/0019044 | A1 * | 1/2003 | Larsson et al. | 5/724 |
| 2003/0050007 | A1 * | 3/2003 | Gebke | 454/306 |
| 2008/0005843 | A1 | 1/2008 | Lokhorst et al. | |
| 2009/0106907 | A1 * | 4/2009 | Chambers | 5/714 |
| 2009/0217460 | A1 | 9/2009 | Bobey et al. | |
| 2010/0132116 | A1 * | 6/2010 | Stacy et al. | 5/423 |
| 2010/0212089 | A1 | 8/2010 | Kajiwara et al. | |
| 2011/0010855 | A1 | 1/2011 | Flessate | |
| 2011/0047708 | A1 * | 3/2011 | Rensink et al. | 5/706 |
| 2011/0061169 | A1 | 3/2011 | Liu et al. | |
| 2011/0068939 | A1 * | 3/2011 | Lachenbruch | 340/626 |
| 2011/0107514 | A1 | 5/2011 | Brykalski et al. | |
| 2011/0115635 | A1 * | 5/2011 | Petrovski et al. | 340/584 |
| 2011/0247143 | A1 * | 10/2011 | Richards et al. | 5/713 |
| 2011/0258778 | A1 | 10/2011 | Brykalski et al. | |
| 2011/0302719 | A1 | 12/2011 | Schwirian et al. | |
| 2012/0017376 | A1 | 1/2012 | Mikkelsen et al. | |
| 2013/0074272 | A1 * | 3/2013 | Lachenbruch et al. | 5/691 |
| 2013/0205506 | A1 * | 8/2013 | Lachenbruch et al. | 5/691 |

FOREIGN PATENT DOCUMENTS

| | | | |
|---|---|---|---|
| EP | 0046008 | A1 | 2/1982 |
| EP | 1987806 | B1 | 3/2012 |
| WO | 2006001980 | A2 | 1/2006 |
| WO | 2006060796 | A2 | 6/2006 |

* cited by examiner

TOPPER FOR A PATIENT SURFACE

This application claims the benefit, under 35 U.S.C. §119(e), of U.S. Provisional Application No. 61/770,704, which was filed Feb. 28, 2013, and which is hereby incorporated by reference herein in its entirety.

BACKGROUND

The present disclosure is related to surfaces, sometimes called mattresses, for supporting patients. More specifically, the present disclosure is related to a surface including a topper.

Surfaces are typically mounted on frames to provide patient support apparatuses. In one example, a surface may be embodied as a therapeutic mattress and a frame may be embodied as a bed frame of a hospital bed. Some such surfaces may include cushions and toppers that extend over the cushions along the interface of a patient with the surface. Other examples of patient support apparatuses include long-term care beds, surgical tables, X-ray tables, stretchers, wheelchairs, and the like.

Toppers used in surfaces may conduct air along the interface of a patient with the surface to keep the patient's skin cool and dry. Skin that is cool and dry has a reduced incidence of bed sores (also known as pressure sores or decubitus ulcers). Some toppers that conduct air require a large volume of air to be supplied to them in order to provide an effective amount of cooling and drying to a patient's skin.

SUMMARY

The present application discloses one or more of the features recited in the appended claims and/or the following features which, alone or in any combination, may comprise patentable subject matter:

According the present disclosure, a topper may include a top layer of fabric, a bottom layer of fabric spaced apart from the top layer, and a middle layer of material arranged between the top layer and the bottom layer. The middle layer may include a first piece of material and a second piece of material generally adjacent to the first piece of material when viewed from above. The second piece of material may be separated from the first piece of material to block pneumatic communication between the first piece of material and the second piece of material. The first piece of material may comprise three-dimensional material configured to conduct air between the top layer of fabric and the bottom layer of fabric.

In some embodiments, the second piece of material may be three-dimensional material. The middle layer may also include a divider comprising a fabric extending between the top layer and the bottom layer and arranged between the first piece of material and the second piece of material.

In some embodiments, the patient support apparatus may also include a first distribution sleeve made of fabric coupled to the bottom layer and in pneumatic communication with the first piece of material. The patient support apparatus may also include a second distribution sleeve made of fabric coupled to the bottom layer and in pneumatic communication with the first piece of material. The first distribution sleeve may be coupled to a central portion of the bottom layer located between the head end and the foot end of the topper.

In some embodiments, the first piece of material may be spaced apart from the foot end of the topper. The second piece of material may be located between the first piece of material and the foot end of the topper. The first piece of material may be spaced apart from the first lateral side and the second lateral side of the topper.

In some embodiments, the second piece of material may be located between the first piece of material and the first lateral side of the topper. The second piece of material may be located between the first piece of material and the second lateral side of the topper. The second piece of material may be located between the first piece of material and the foot end of the topper.

According to another aspect of the present disclosure, a patient support apparatus may include a cushion adapted to support a patient and a topper. The topper may be arranged to extend over a top side of the cushion and may be configured to conduct air along an actively-cooled region of the top side of the cushion. The actively-cooled region may be spaced apart from a foot end of the cushion.

In some embodiments, the actively-cooled region may be spaced apart from a first lateral side and a second lateral side of the cushion. The topper may include a top layer of fabric, a bottom layer of fabric, and a first piece of three-dimensional material that may be arranged between the top layer of fabric and the bottom layer of fabric.

In some embodiments, the first sheet of three-dimensional material may cooperate with the top layer of fabric and the bottom layer of fabric to define the actively-cooled region. The topper may include an air distribution sleeve coupled to the bottom layer of fabric and in pneumatic communication with the first piece of three-dimensional material.

In some embodiments, the cushion may include a first inflatable bladder and a second inflatable bladder. The air distribution sleeve may extend between the first inflatable bladder and the second inflatable bladder.

In some embodiments, the topper may include a second piece of three-dimensional material arranged between the top layer of fabric and the bottom layer of fabric. The second sheet of three-dimensional material may cooperate with the top fabric layer to define a passively-cooled region that is pneumatically separated from the actively-cooled region.

According to another aspect of the present disclosure, a patient support apparatus may include a cushion adapted to support a patient and a topper. The topper may be arranged to extend over a top side of the cushion. The topper may be configured to conduct air from a first origination point spaced a first distance from a foot end of the cushion toward the head end of the cushion, and may be configured to conduct air from a second origination point spaced a second distance from the foot end of the cushion toward the head end of the cushion.

In some embodiments, the topper may include a top layer of fabric, a bottom layer of fabric, a first piece of three-dimensional material arranged between the top layer of fabric and the bottom layer of fabric, and a second piece of three-dimensional material pneumatically separated from the first sheet of three-dimensional material. The first piece of three-dimensional material and the second piece of three-dimensional material may be arranged between the top layer and the bottom layer of fabric. In some embodiments, the first piece of three-dimensional material may overlie the first origination point and the second origination point when viewed from above Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
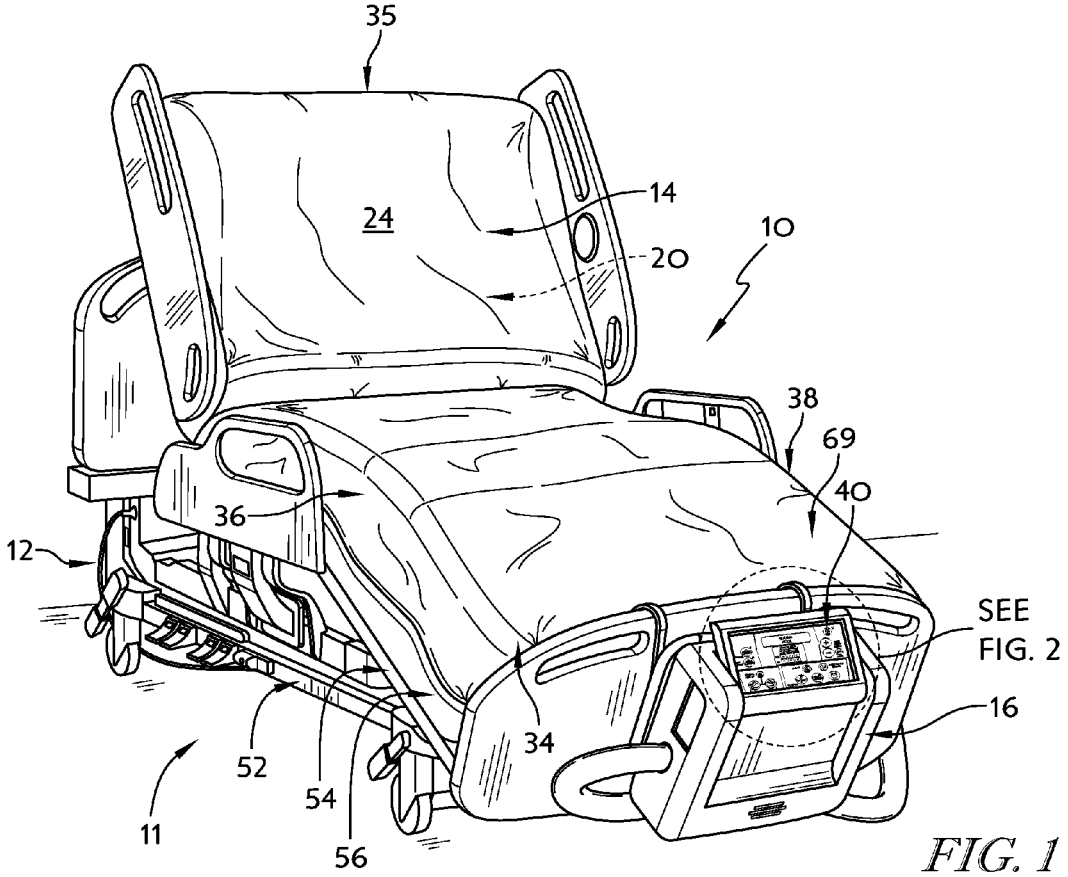
FIG. 1 is a perspective view of a patient support apparatus including a frame, a surface (or mattress), and an air box coupled to the surface to provide air to a topper included in the surface.

A patient support apparatus 10 illustratively includes a frame 12, a patient support surface 14 (sometimes called surface 14) supported on the frame 12, and an air box 16 as shown in FIG. 1. The surface 14 is adapted to support a patient lying on the patient support apparatus 10 and includes a topper 20 (shown in FIGS. 5-7) that extends along a top side 24 of the surface 14. The topper 20 is configured to conduct air along the top side 24 of the surface 14 adjacent to the interface of the surface 14 with a patient. The air conducted by the topper 20 is pressurized and pushed through the topper 20 by the air box 16. By conducting air along the interface of the surface 14 and the patient, the topper 20 cools and dries the patient's skin in order to reduce the risk of bed sore formation by the patient.

Figure 2:
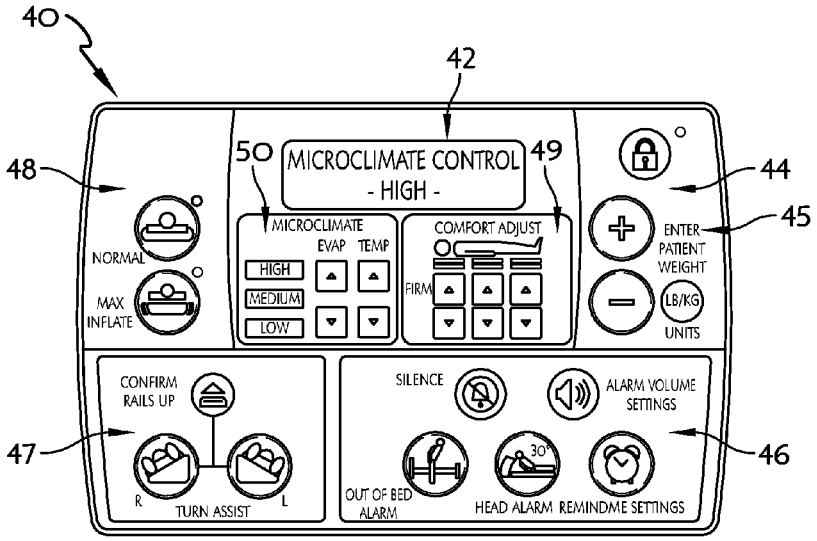
FIG. 2 is a detail view of a user interface included in the air box of FIG. 1.

The air box 16 includes a user interface 40 shown in detail in FIG. 2. The user interface 40 includes a display screen 42 and a plurality of buttons 44 for inputting patient information and for controlling operation of the air box 16 and the surface 14. More specifically, the user interface 40 includes a patient information input panel 45, an alarm panel 46, a lateral rotation therapy panel 47, an inflation mode panel 48, a normal inflation control panel 49, and a microclimate control panel 50.

The microclimate control panel 50 allows a user to adjust the flow of air provided by the air box 16 to the topper 20 and to adjust the temperature of air provided by the air box 16 to the topper 20 as suggested in FIG. 2. Illustratively, a caregiver could increase flow of air from the air box 16 to the topper 20 by pressing an up evaporation (EVAP) arrow and could increase the temperature of air from the air box 16 to the topper by pressing an up temperature (TEMP) arrow. Additionally, a preset level of flow and temperature could be selected by pressing a preset high, medium, or low button included in the microclimate control panel 50. In some embodiments, the temperature controls may be omitted.

Figure 3:
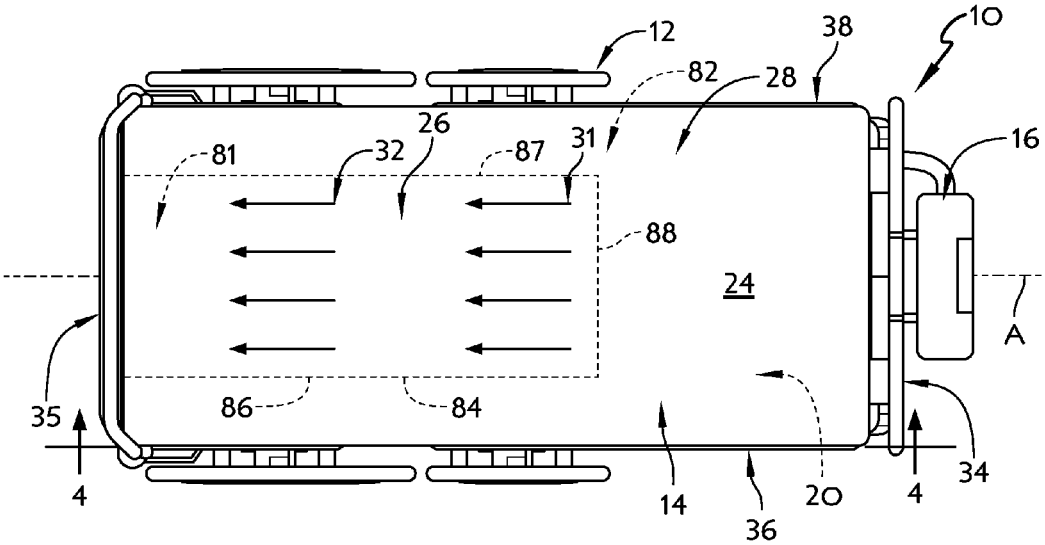
FIG. 3 is a top plan view of the hospital bed of FIG. 1 with air provided to the topper that flows through an actively-cooled region of the topper that is smaller than the entire footprint of the surface.
Figure 4:
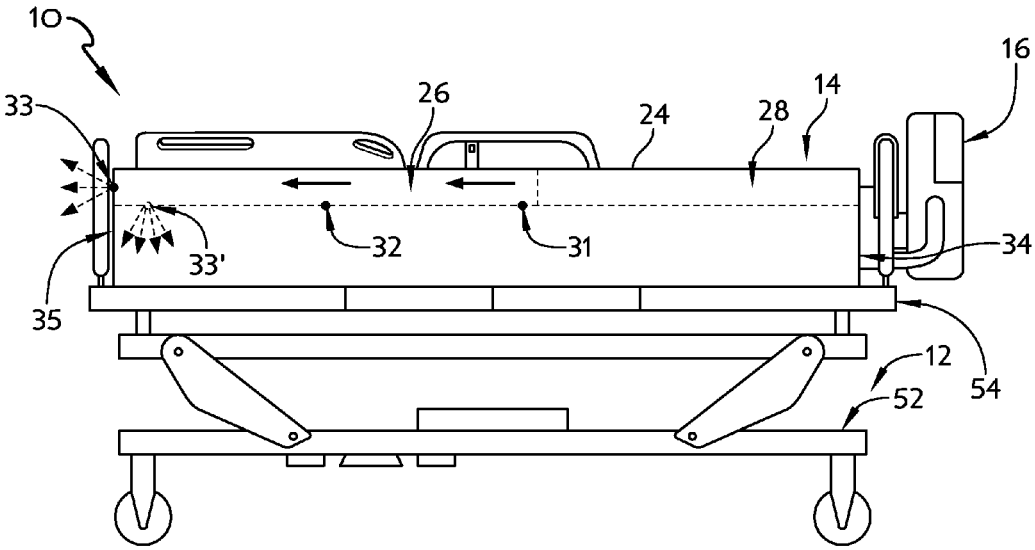
FIG. 4 is a side elevation view of the bed of FIG. 1, with air being provided to the topper that exhausts at the head end of the topper positioned on the left side of FIG. 4.

The illustrative topper 20 is configured to receive air from the air box 16 and to conduct air pushed through the topper 20 by the air box 16 along an actively-cooled region 26 of the topper 20 as shown in FIG. 3. The topper 20 also allows natural air flow to occur in a passively-cooled region 28 of the topper 20 adjacent to the actively-cooled region 26. The actively-cooled region 26 is arranged to underlie a patient's pelvic region and torso region in order to reduce the risk of bed sore formation around a patient's pelvis (particularly under the sacrum) and around a patient's shoulders (particularly under the scapulae). Additionally, in the illustrative embodiment, air from the air box 16 is introduced into the topper 20 at a first origination point 31 near a patient's pelvic region and at a second origination point 32 near a patient's shoulders. The air flows to exhaust through an outlet 33 positioned at the head end 35 of the topper 20 as shown in FIG. 4. In some embodiments, the air may exhaust through an outlet 33' positioned on a bottom side of the topper 20 as suggested in FIG. 4.

By reducing the area through which the air box 16 is required to push air, the illustrative topper 20 allows for reduction of the pressure and flow needed from an air source (blower, compressor, etc) included in the air box 16. Further, by directing the location of air introduction from the air box 16 under specific high-risk portions of a patient heat and moisture withdrawal from such areas may be comparable to other systems known in the art using a relatively small amount of air.

A portion of the passively-cooled region 28 is arranged to underlie a patient's legs and sometimes arms near a foot end 34 and lateral sides 36, 38 of the surface 14 as shown in FIG. 3. The passively-cooled region 28 allows for natural air flow under a patient to be driven by temperature gradients across the topper 20 induced by the patient's body heat. Such natural air flow can provide heat and moisture withdrawal sufficient to reduce the risk of bed sores without air flow from the air box 16.

Figure 5:
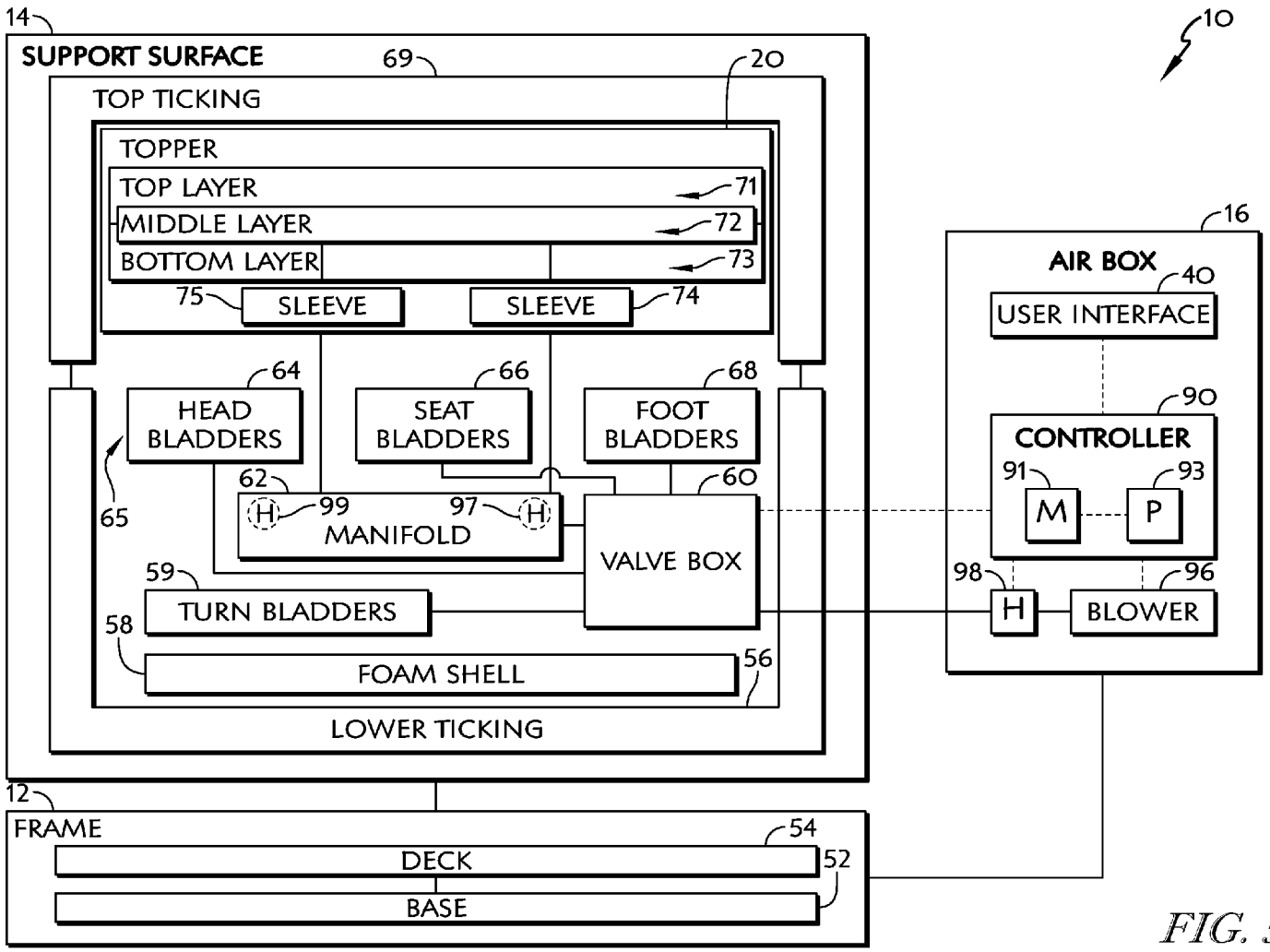
FIG. 5 is a diagrammatic view of the hospital bed of FIG. 1 showing that the frame includes a base and a deck, that the surface includes ticking, a foam shell, a plurality of inflatable bladders, a valve box, a manifold, and the topper for conducting air along the interface of a patient with the surface, and that the air box includes a controller, a blower, a heater, and the user interface.

Turning to FIG. 5, the patient support apparatus 10 is shown diagrammatically to include the frame 12, the surface 14, and the air box 16. However, it should be appreciated that the frame 12 alone, the surface 14 alone, a combination of the frame 12 and the air box 16, or a combination of the surface 14 and the air box 16 may provide a patient support apparatus as the term is applied herein.

As shown in FIG. 5, the frame 12 illustratively includes a base 52 and a deck 54. The base 52 is configured to support the deck 54, the surface 14, and the air box 16 above a floor 11. The deck 54 underlies the surface 14 and is reconfigurable to adjust the position of the surface 14 when a patient is on the patient support apparatus 10 so that a patient can be supported while lying flat, sitting up in bed, or in a number of other positions. In some embodiments, the air box 16 may be integrated into the frame 12 or independently supported rather than being coupled to the frame 12 as in the illustrative embodiment.

Figure 6:
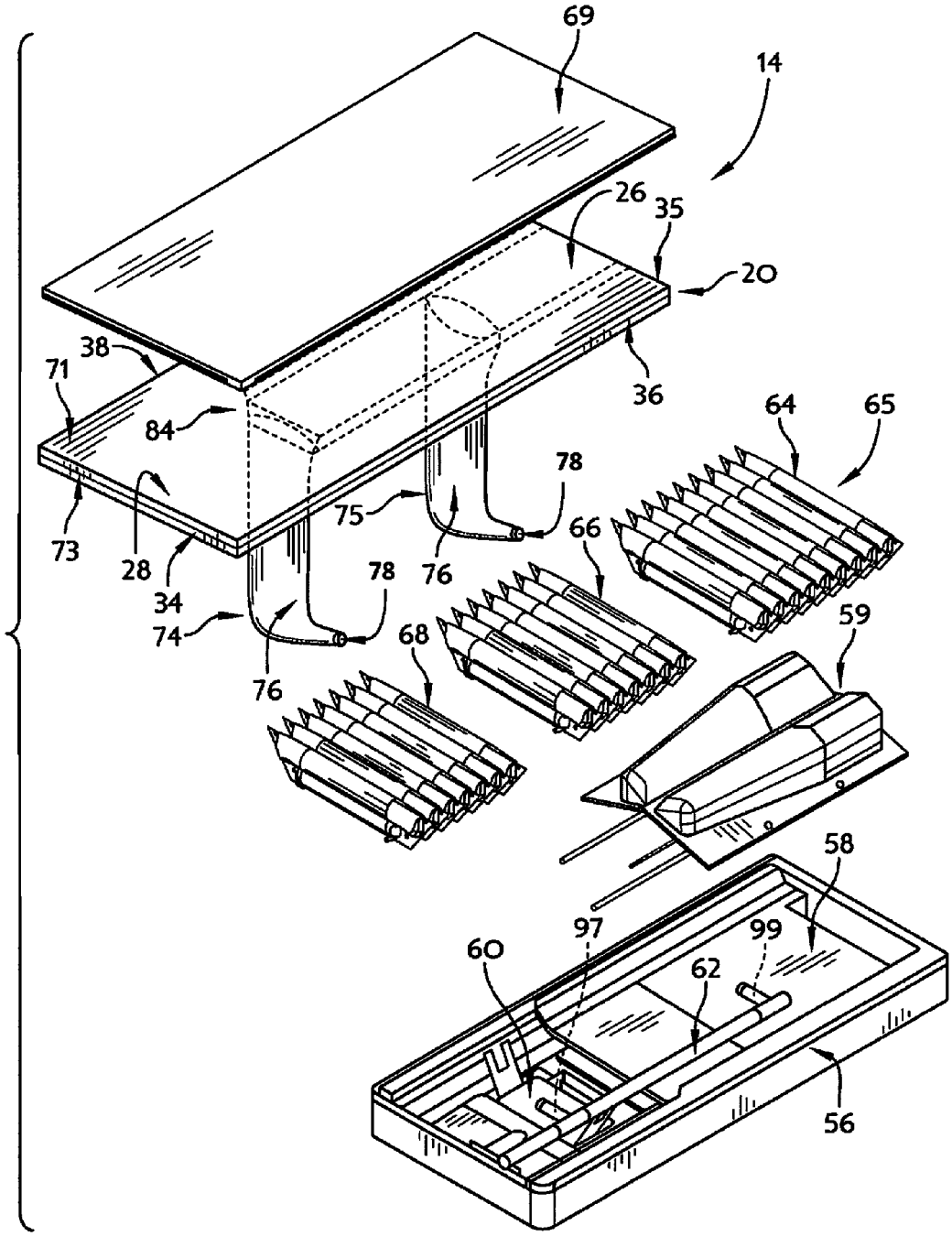
FIG. 6 is an exploded perspective view of the surface of FIGS. 1 and 4 with the illustrative topper arranged above the inflatable bladders of the surface and configured to be pneumatically coupled to the valve box positioned under the inflatable bladders.

The surface 14 includes (from bottom to top) a lower ticking 56, a foam shell 58, turn bladders 59, a valve box 60, an air manifold 62, inflatable support bladders 65, the topper 20, and an upper ticking 69 as shown in FIGS. 5 and 6. The lower ticking 56 and the upper ticking 69 cooperate to encase the other components of the surface 14 as suggested in FIGS. 5 and 6. The foam shell 58 cooperates with the inflatable support bladders 65 to provide a cushion on which the patient is supported while positioned on the patient support apparatus 10.

The turn bladders 59 are coupled to the air box 16 through the valve box 60 and may be inflated to rotate a patient about a longitudinal axis 14A of the surface 14 as suggested in FIG. 6. In addition to the turn bladders 59, the valve box 60 is pneumatically coupled to the topper 20 via the air manifold 62 and to the support bladders 64, 66, 68 to distribute air from the air box 16 around the surface 14. The air manifold 62 receives air from the air box 16 via the valve box 60 and delivers the air to the topper 20 near the origination points 31, 32 as suggested in FIGS. 5 and 6.

The inflatable support bladders 65 illustratively include head section bladders 64, seat section bladders 66, and foot section bladders 68 as shown in FIGS. 5 and 6. Each section of bladders 64, 66, 68 is inflatable to different pressures depending on pressure level selected on the user interface 40 for patient comfort. Each section of bladders 64, 66, 68 may also be inflated or deflated to provide patient therapies or to reduce the risk of bed sores. In other embodiments, the bladders 64, 66, and 68 may be omitted and foam padding may replace one or more of the inflatable section bladders 64, 66, 68.

Figure 7:
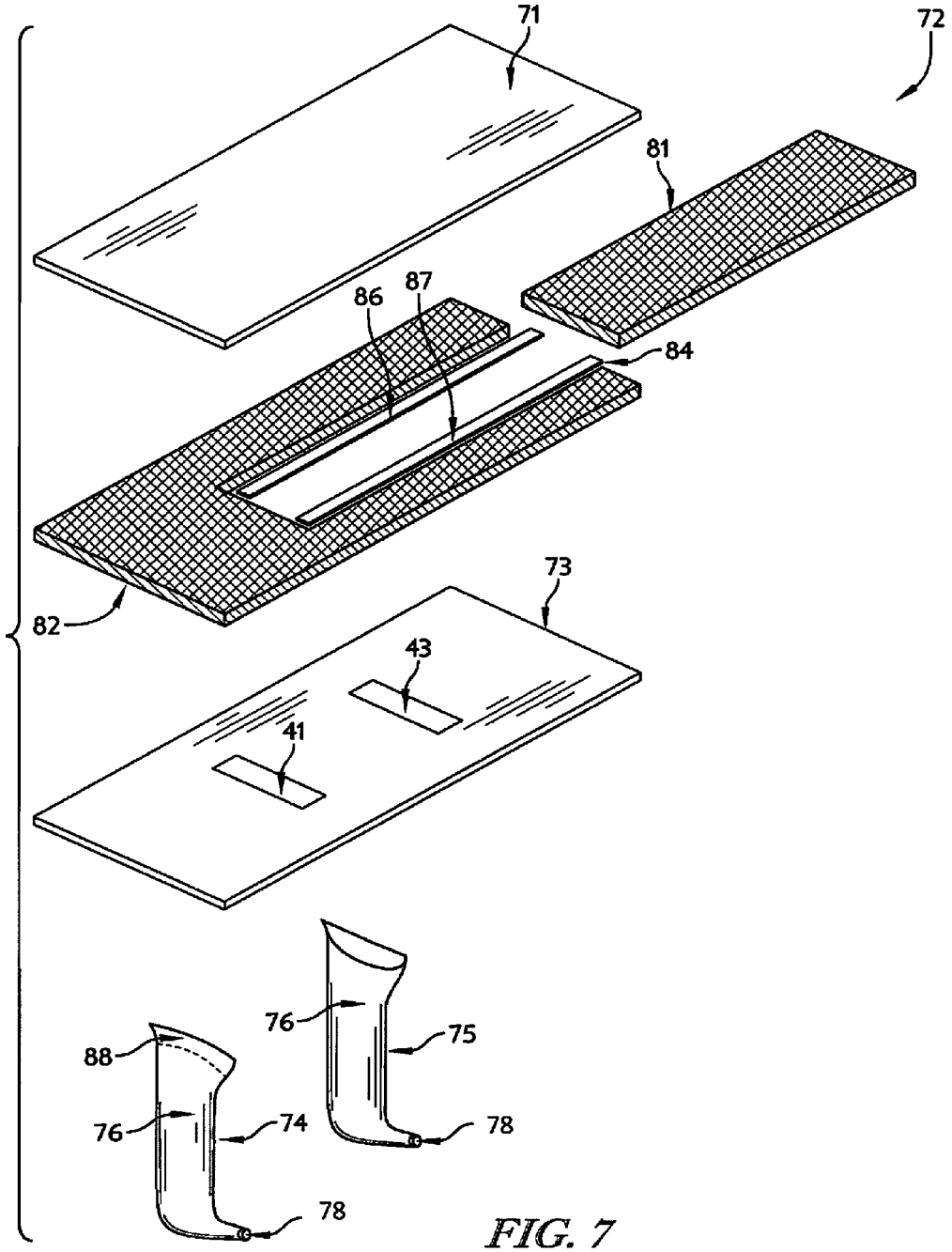
FIG. 7 is an exploded perspective view of the topper of FIGS. 4 and 5 showing that the topper includes a top layer made of fabric, a middle layer including two pieces of three-dimensional material, a bottom layer made of fabric, and two distribution sleeves made of fabric and configured to conduct air from the valve box under the inflatable bladders to one of the pieces of three-dimensional material.

The topper 20 illustratively includes a top layer 71 configured to underlie a patient on the patient support apparatus 10, a bottom layer 73 spaced apart from the top layer 71, a middle layer 72 arranged between the top layer 71 and the bottom layer 73, and a pair of distribution sleeves 74, 75 as shown in FIGS. 5-7. The top layer 71 and the bottom layer 73 are illustratively made from a vapor-permeable, liquid-impermeable fabric. More particularly, in the illustrative embodiment, the top layer 71 and the bottom layer 73 are made of urethane coated nylon available from Uretek of New Haven, Conn. In other embodiments, the bottom layer 73 may be made from vapor-impermeable, liquid-impermeable fabric. The middle layer is configured to provide an air gap between the top layer and the bottom layer 73. The bottom layer 73 is formed to include a first inlet port 41 and a second inlet port 43 each arranged under the actively-cooled region 26 and spaced apart from one another along a longitudinal axis A of the topper 20 as shown in FIG. 7.

The distribution sleeves 74, 75 are coupled to the bottom layer 73 and extend downwardly from the bottom layer 73 to connect the topper 20 to the manifold 62 as shown in FIG. 6. Further, the distribution sleeve 74 extends between the foot section bladders 68 and the seat section bladders 66, and the distribution sleeve 75 extends between the seat section bladders 66 and the head section bladders 64 as suggested in FIG. 6.

The distribution sleeves 74, 75 each include a flexible diffuser 76 and a fitting 78 as shown in FIGS. 5 and 6. The flexible diffusers 76 are illustratively made from the same fabric used in the top layer 71 and the bottom layer 73 of the topper 20 so that the distribution sleeves 74, 75 do not cause discomfort for a patient laying on the surface 14 when the support bladders 65 are mostly deflated. Each flexible diffuser 76 is configured to receive air from the manifold 62 and to deliver the air to the middle layer 72 of the topper 20 at the origination points 31, 32 along the width of the actively-cooled region 26 of the topper 20 as suggested in FIGS. 5 and 6. The fitting 78 is configured to couple the flexible diffuser 76 to the manifold 62 and may be a quick-disconnect fitting.

The middle layer 72 of the exemplary embodiment is configured to conduct air from the origination points 31, 32 along the top surface 24 of the surface 14 and to separate the actively-cooled region 26 from the passively-cooled region 28 of the topper 20 as shown in FIGS. 6 and 7. The middle layer 72 illustratively includes a first piece of three-dimensional material 81, a second piece of three-dimensional material 82, and a divider 84 that pneumatically separates the first piece of three-dimensional material 81 from the second piece of three-dimensional material 82.

The first piece of three-dimensional material 81 is illustratively arranged to lie under a patient's pelvic area and torso area as shown in FIGS. 6 and 7. The first piece of three-dimensional material 81 cooperates with the top layer 71 and the bottom layer 73 to define the actively-cooled region 26 of the topper 20. In the illustrative embodiment, the first piece of three-dimensional material 81 is arranged to extend from the head end 35 of the topper 20 toward the foot end 34 of the topper 20 as shown in FIGS. 6 and 7. The first piece of three-dimensional material 81 is further spaced apart from the foot end 34 and from the lateral sides 36, 38 of the topper 20. The first piece of three-dimensional material 81 is illustratively rectangular and is adjacent to the second piece of three-dimensional material 82 when viewed from above as shown in FIGS. 6 and 7. In other embodiments, the first piece of three-dimensional material 81 may be located in other positions relative to a patient and/or may be broken into different portions to create multiple actively cooled regions of the topper 20.

The second piece of three-dimensional material 82 is illustratively arranged to lie under a patient's legs and feet as shown in FIGS. 6 and 7. The second piece of three-dimensional material 82 cooperates with the top layer 71 and the bottom layer 73 of the topper 20 to define the passively-cooled region 28 of the topper 20. In the illustrative embodiment, the second piece of three-dimensional material 82 is arranged to extend from the head end 35 to the foot end 34 of the topper 20 surrounding the first piece of three-dimensional material 81 so that the entire area of the topper 20 provides cooling for a patient's skin. The second piece of three-dimensional material 82 is illustratively U-shaped when viewed from above and opens toward the head end 35 of the topper 20 as shown in FIGS. 6 and 7. In some embodiments, the second piece of material 82 may be made from another material such as foam, fabric, padding, filler, or the like in order to maintain the thickness of the topper 20 without providing cooling outside the actively-cooled region 26 of the topper 20.

The divider 84 includes three strips 86, 87, 88 as shown in FIG. 7. In the illustrative embodiment, the strip 88 is part of the first distribution sleeve 74 as shown in FIG. 7. The strips 86, 87, 88 are each made of the same fabric used in the top layer 71 and the bottom layer 73 of the topper 20 but in other embodiments may be made from other fabrics or plastics.

In the illustrative embodiment, the strips 86, 87, 88 are each sewn to the top layer 71 and the bottom layer 73 to create a barrier between the first piece of three-dimensional material 81 and the second layer of three-dimensional material 82 as shown in FIG. 6. In some embodiments, the strips 86, 87, 88 may be adhered or welded to the top layer 71 and the bottom layer 73 in addition to and/or in place of sewing. In other embodiments, the divider 84 may be formed without the strips 86, 87, 88 by sewing the top layer 71 to the bottom layer 73 between the first and second pieces of three-dimensional material 81, 82.

Figure 8:
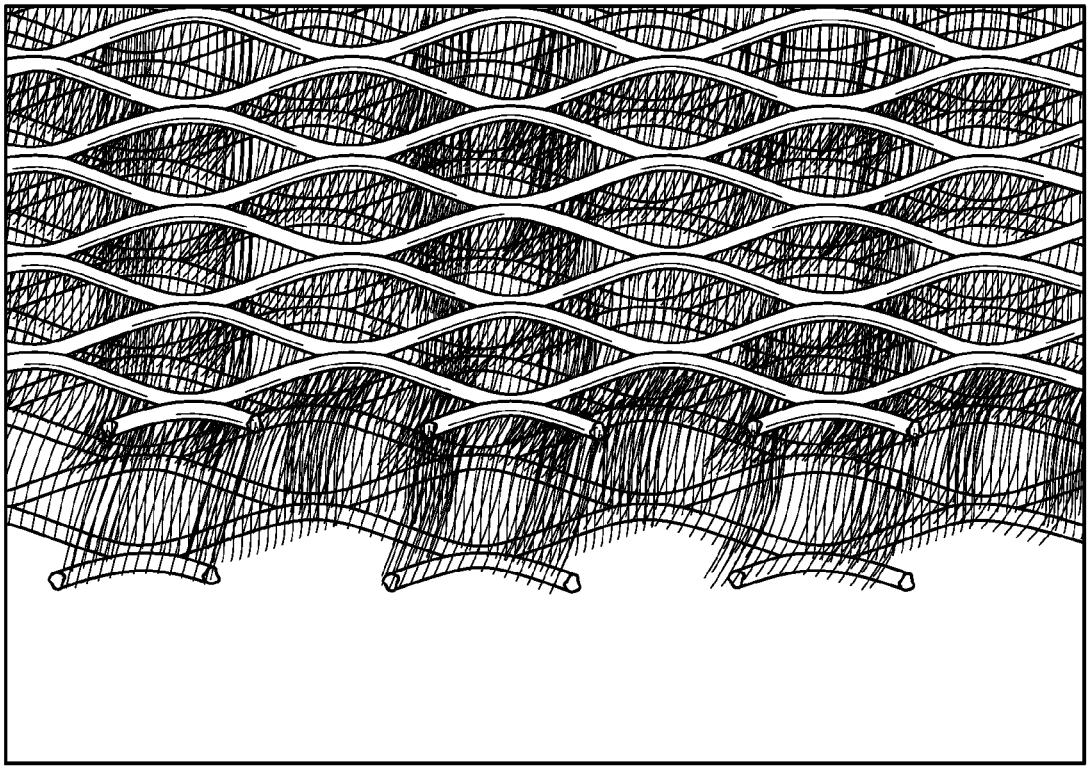
FIG. 8 is a perspective view of one of the pieces of three-dimensional material showing that the three-dimensional material provides air gaps through which air can flow to carry away heat and/or moisture from a patient's skin.

FIG. 8 is a detail perspective view of a piece of the three-dimensional material used to create the first piece and the second piece of three-dimensional material 81, 82 used in the middle layer 72 of the topper 20. In the illustrative embodiment, each piece of three-dimensional material 81, 82 is available under the trade name PRESSLESS® from Bodet & Horst GmbH & Co. In other embodiments, other three-dimensional material may be used to provide an air gap between the top layer 71 and the bottom layer 73 of the topper 20 when a patient is lying on the topper 20.

It should be understood that in other embodiments, the actively-cooled region 26 may be arranged in other positions around the topper 20, may have different total area or shape, and/or may be split into more than one area around the topper 20. For example, in some embodiments, the actively-cooled region 26 may be spaced apart from the head end 35 of the topper 20 and may be surrounded by the passively-cooled region 28 while still being arranged to underlie a patient's pelvic area and torso area. In some embodiments, the actively-cooled region 26 may be expanded toward the foot end 34 of the topper 20 to underlie a patient's feet in addition to her pelvic area and her torso area. In some embodiments, the actively-cooled region 26 may include a first area arranged to underlie a patient's pelvic area, a second area arranged to underlie a patient's torso area, and/or a third area arranged to underlie a patient's feet.

Referring back to FIG. 5, the air box 16 illustratively includes the user interface 40, a controller 90, a blower 96, and a heater 98. The controller 90 is coupled for communication with the user interface 40, the blower 96, and the heater 98 as shown diagrammatically in FIG. 5. The controller 90 is also coupled for communication with the valve box 60. The blower 96 provides pressurized air for the inflatable bladders 59, 65 and for the topper 20. The heater 98 is arranged inline with the blower 96 and is configured to warm air from the blower 96 before the air is delivered to the topper 20. In some embodiments, a cooler (not shown) or other air conditioning device(s) may also be included between the blower 96 and the topper 20 to prepare the air for use in therapeutic flow adjacent to a patient's skin.

In some embodiments, the heater 98 may be replaced or augmented with optional heaters 97, 99 situated in the manifold 62 and associated with the first and second origination points 31, 32, respectively, as shown in FIG. 5. The inclusion of optional heaters 97, 99 allows for location-specific temperature control of therapeutic air applied adjacent to different portions of a patient while on the patient support apparatus 10.

The illustrative controller 90 includes a memory 91 and a processor 93 as shown in FIG. 5. The memory 91 is configured to hold instructions and data for use by the processor 93. The processor 93 executes the instructions on the memory 91 and writes information to the memory 91, for example, adjusting operation of the blower 96 and valve box 60 based on inputs received from the user interface 40 as proscribed by the instructions written in the memory 91.

Although certain illustrative embodiments have been described in detail above, variations and modifications exist within the scope and spirit of this disclosure as described and as defined in the following claims.

The invention claimed is:

1. A patient support apparatus comprising a cushion including inflatable air bladders, and a topper having a head end, a foot end, a first lateral side, and a second lateral side, the topper comprising:

a top layer of fabric, a bottom layer of fabric spaced apart from the top layer, a middle layer arranged between the top layer and the bottom layer, the middle layer including a first piece of material and a second piece of material generally adjacent to the first piece of material when viewed from above and separated from the first piece of material to block pneumatic communication between the first piece of material and the second piece of material, the first piece of material comprising three-dimensional material configured to conduct air between the top layer of fabric and the bottom layer of fabric, the first piece of material having a head-end edge corresponding to the head end of the topper, a foot-end edge corresponding to the foot end of the topper, a first-lateral-side edge corresponding to the first lateral side of the topper, and a second-lateral-side edge corresponding to the second lateral side of the topper, a first fluid distributor comprising a flexible fabric sleeve arranged between inflatable air bladders included in the cushion, the first fluid distributor in pneumatic communication with the first piece of material, the first fluid distributor being connected to the first piece of material at a first origination point spaced apart from the head-end edge and the foot-end edge of the first piece of material, and a second fluid distributor comprising a flexible fabric sleeve arranged between inflatable air bladders included in the cushion, the second fluid distributor in pneumatic communication with the first piece of material, the second fluid distributor being connected to the first piece of material at a second origination point located at the foot-end edge of the first piece of material, the first and second fluid distributors being adapted to conduct active cooling to the first piece of material, wherein the second piece of material is free from pneumatic communication with any fluid distributor that is adapted to conduct active cooling air to the second piece of material.

2. The topper of claim 1, wherein the second piece of material is three-dimensional material.

3. The topper of claim 2, wherein the middle layer includes a divider extending between the top layer and the bottom layer and arranged between the first piece of material and the second piece of material.

4. The topper of claim 1, wherein the flexible fabric sleeve of the first fluid distributor is coupled to a central portion of the bottom layer located between the head end and the foot end of the topper.

5. The topper of claim 1, wherein the first piece of material is spaced apart from the foot end of the topper.

6. The topper of claim 5, wherein the second piece of material is located between the first piece of material and the foot end of the topper.

7. The topper of claim 5, wherein the first piece of material is spaced apart from the first lateral side and the second lateral side of the topper.

8. The topper of claim 7, wherein the second piece of material is located between the first piece of material and the first lateral side of the topper, and the second piece of material is located between the first piece of material and the second lateral side of the topper.

9. The topper of claim 8, wherein the second piece of material is located between the first piece of material and the foot end of the topper.

10. A patient support apparatus comprising a cushion including a plurality of inflatable bladders adapted to support a patient, and a topper arranged to extend over a top side of the cushion and configured to conduct air along an actively-cooled region of the top side of the cushion from a fluid distributor in pneumatic communication with the actively-cooled region while also providing a passively-cooled region of the top side of the cushion free of pneumatic communication with any fluid distributors, wherein the actively-cooled region is spaced apart from a foot end of the cushion and the fluid distributor comprises a flexible fabric sleeve arranged between inflatable air bladders included in the cushion, wherein the fluid distributor is connected to the actively-cooled region for pneumatic communication at a point that corresponds to a patient's pelvic region while the patient is lying in a supine position with feet adjacent to the foot end of the topper and that is spaced apart from a head end and the foot end of the cushion.

11. The patient support apparatus of claim 10, wherein the actively-cooled region is spaced apart from a first lateral side and a second lateral side of the cushion.

12. The patient support apparatus of claim 11, wherein the topper includes a top layer of fabric, a bottom layer of fabric, and a first piece of three-dimensional material arranged between the top layer of fabric and the bottom layer of fabric.

13. The patient support apparatus of claim 12, wherein the first sheet of three-dimensional material, the top layer of fabric, and the bottom layer of fabric define the actively-cooled region.

14. The patient support apparatus of claim 12, wherein the fluid distributor is coupled to the bottom layer of fabric.

15. The patient support apparatus of claim 12, wherein the topper includes a second piece of three-dimensional material arranged between the top layer of fabric and the bottom layer of fabric, wherein the second sheet of three-dimensional material and the top fabric layer define the passively-cooled region that is pneumatically separated from the actively-cooled region.

16. The patient support apparatus of claim 10, wherein a second fluid distributor is connected to the actively-cooled region for pneumatic communication at a point that corresponds to the patient's shoulders and that is spaced apart from the head end and the foot end of the cushion.

17. A patient support apparatus comprising a cushion including a plurality of inflatable bladders adapted to support a patient, and a topper arranged to extend over a top side of the cushion and configured to receive air from a first origination point and that is spaced a first distance from a foot end of the cushion and is spaced apart from the head end of the cushion, wherein the topper includes a top layer of fabric, a bottom layer of fabric, a first piece of three-dimensional material arranged between the top layer of fabric and the bottom layer of fabric, a first fluid distributor pneumatically coupled to the first piece of three-dimensional fabric and comprising a flexible fabric sleeve that extends between inflatable bladders of the cushion, and a second piece of three-dimensional material pneumatically separated from the first sheet of three-dimensional material arranged between the top layer and the bottom layer of fabric, wherein the second piece of material defines a passively-cooled region free of pneumatic communication with distribution mechanisms and the second piece of three-dimensional material is pneumatically separated from the first piece of three-dimensional material by a divider that extends from the top layer of fabric to the bottom layer of fabric spacing the top layer of fabric from the bottom layer of fabric to accommodate at least a portion of a thickness of one of the first piece of three-dimensional material and the second piece of three-dimensional material.

18. The patient support apparatus of claim 17, wherein the divider includes a strip of material coupled to the top layer of fabric and to the bottom layer of fabric.

19. The patient support apparatus of claim 18, wherein the strip of material is part of the flexible fabric sleeve.

20. The patient support apparatus of claim 18, wherein the strip of fabric is sized so that a distance between the top layer of fabric and the bottom layer of fabric is substantially the same as a thickness of the first piece of three-dimensional material and the second piece of three-dimensional material is maintained so that a thickness of the topper at an interface of the first piece of three-dimensional material and the second piece of three-dimensional material is substantially equal to the thickness of the topper adjacent to the interface when the first piece of three-dimensional material and the second piece of three-dimensional material are uncompressed.

21. The patient support apparatus of claim 17, wherein the topper is configured to conduct the received air from the first origination point toward the head end of the cushion and to receive air from a second origination point near to a location that is spaced a second distance from the foot end of the cushion and is spaced apart from the head end of the cushion and to conduct the received air toward the head end of the cushion.

22. A patient support apparatus comprising a cushion, and a topper having a head end, a foot end, a first lateral side, and a second lateral side, the topper comprising a top layer of fabric, a bottom layer of fabric spaced apart from the top layer, a middle layer arranged between the top layer and the bottom layer, the middle layer including a first piece of material and a second piece of material generally adjacent to the first piece of material when viewed from above and separated from the first piece of material to block pneumatic communication between the first piece of material and the second piece of material, the first piece of material comprising three-dimensional material configured to conduct air between the top layer of fabric and the bottom layer of fabric, a first fluid distributor in pneumatic communication with the first piece of material, the first fluid distributor being connected to the first piece of material at a first origination point that is near to a location that corresponds to one of a patient's pelvic region or shoulders and that is spaced apart from the foot end and the head end, and a second fluid distributor in pneumatic communication with the first piece of material, the second fluid distributor being connected to the first piece of material at a second origination point that is near to a location that corresponds to the other of a patient's pelvic region or shoulders and that is spaced apart from the foot end and the head end, the first and second fluid distributors being adapted to conduct active cooling to the first piece of material, wherein the second piece of material is free from pneumatic communication with any fluid distributor that is adapted to conduct active cooling air to the second piece of material, wherein the first fluid distributor is a first distribution sleeve coupled to the bottom layer and in pneumatic communication with the first piece of material, and the first distribution sleeve comprises a fabric and is coupled to a central portion of the bottom layer located between the head end and the foot end of the topper, and wherein the cushion includes a first inflatable bladder and a second inflatable bladder, and the first distribution sleeve extends between the first inflatable bladder and the second inflatable bladder.

* * * * *